United States Patent [19]

Challande et al.

[11] Patent Number: 5,044,658

[45] Date of Patent: Sep. 3, 1991

[54] SAFETY SKI BINDING ADAPTED TO COMPENSATE FOR DIFFERENT THICKNESSES OF SOLES OF SKI BOOTS

[75] Inventors: Christian Challande, Cruseilles; Jean-Pierre Boussemart, Choisy, both of France

[73] Assignee: Salomon S.A., Annecy Cedex, France

[21] Appl. No.: 448,836

[22] Filed: Dec. 12, 1989

[30] Foreign Application Priority Data

Dec. 16, 1988 [FR] France ..... 8816661

[51] Int. Cl.[5] ..... A63C 9/08

[52] U.S. Cl. ..... 280/631; 280/634; 280/636

[58] Field of Search ..... 280/623, 625, 626, 628, 280/630, 631, 634, 636

[56] References Cited

U.S. PATENT DOCUMENTS

| | | | |
|---|---|---|---|
| 3,265,400 | 8/1966 | Hvam | 280/630 |
| 3,544,124 | 12/1970 | Beyl | 280/626 |
| 3,909,030 | 9/1975 | Beyl | 280/630 |
| 4,095,821 | 6/1978 | Salomon | 280/628 |
| 4,218,071 | 8/1980 | Salomon | 280/630 |
| 4,402,525 | 9/1983 | Salomon | 280/628 |
| 4,538,828 | 9/1985 | Dimier | 280/628 |
| 4,684,147 | 8/1987 | Pascal et al. | 280/628 |

FOREIGN PATENT DOCUMENTS

| | | |
|---|---|---|
| 1755/86 | 6/1986 | Austria . |
| 2621267 | 11/1977 | Fed. Rep. of Germany . |
| 3605313 | 8/1987 | Fed. Rep. of Germany . |
| 1498661 | 10/1967 | France . |
| 2385418 | 10/1978 | France . |
| 2527083 | 11/1983 | France . |
| 2537442 | 6/1984 | France . |

*Primary Examiner*—Andres Kashnikow
*Assistant Examiner*—Eric Culbreth
*Attorney, Agent, or Firm*—Sandler, Greenblum & Bernstein

[57] ABSTRACT

A safety ski binding, preferably for engaging the front of a ski boot. The binding includes an elastic energization mechanism for the jaw of the binding and a separate arrangement for compensating for different sole thicknesses. In a specific embodiment, the binding is formed as a monobloc and includes a deformation zone to automatically accommodate soles of different thicknesses. The binding also includes a front fall sensor and a rear fall compensating mechanism to further compress the spring of the energization mechanism to lessen the amount of force required to release the boot during front and rear falls.

27 Claims, 3 Drawing Sheets

SAFETY SKI BINDING ADAPTED TO COMPENSATE FOR DIFFERENT THICKNESSES OF SOLES OF SKI BOOTS

BACKGROUND OF THE INVENTION

1. Field of the Invention

The present invention relates to a safety ski binding adapted to hold, in a releasable manner, the front of a boot mounted on the ski.

2. Description of Background and Relevant Information

Known safety ski bindings, called "front abutments", comprise a body mounted on a base which is solidly affixed to the ski. This body supports a retention jaw for the boot at its rear portion, which comprises two opposed lateral retention wings and an energization mechanism lodged in the body to elastically return the jaw to a locking position. The energization mechanism includes a compressed energy spring resting, at one end, on a support surface connected to the body and, at its other end, on a force transmission element which is longitudinally movable in the body and coupled to the jaw so as to elastically bias the jaw against the front of the boot to ensure the retention of the boot on the ski.

The front abutment described in Austrian Patent Document No. 1755/86 includes a fixed body with movable, independent, lateral retention wings. This front abutment includes a central sole-gripping element which is independent of the lateral retention wings and which is vertically movable against the action of the main spring which forms a part of the energization mechanism. However, this abutment includes an independent height adjustment device which determines the initial position of the sole-gripping element in the vertical direction by means of a vertical screw.

Another front abutment, which is described in German Patent No. 36 05 313, includes a fixed body and has a monobloc jaw which moves about one or the other of two support lines against the return action of a spring which is part of the energization mechanism. The upper part of the jaw is also vertically movable by rocking about a horizontal axis. This rocking of the jaw permits the adaptation to soles with different thicknesses, but includes a reaction on the energization spring. In fact, it is the same circuit and the same energy which ensure both the return of the jaw for the vertical movement of adjustment for height and rear fall.

SUMMARY OF THE INVENTION

The present invention relates to improvements to known front abutments, by permitting automatic height adjustment, i.e., without requiring the intervention of the mounter or skier. This facilitates the usage of a single front abutment with boots having soles of different thicknesses without reaction on the spring of the energization mechanism.

To this end, the present invention is directed to a safety ski binding having a front and rear and which is adapted to be mounted on a ski to releasably hold the front of a sole of a ski boot on the ski. The safety ski binding includes a unitary assembly comprising a body having a lower base. The assembly is formed in a single piece and includes a jaw mounted on the assembly for retention of the sole of the ski boot. The jaw includes a sole-gripping element, two opposed lateral retention wings, and an energization mechanism movable in the body to elastically return the jaw to a locking position.

The lower base is adapted to be mounted on the ski so that the lower base and an upper portion of the body are connected together only at the front of the binding at an elastic deformation zone which allows vertical movement of the upper portion of the body with respect to the lower base, to permit the jaw to automatically adapt in height to soles with different thicknesses.

According to one aspect of the invention, the assembly is molded in a single piece to form a monobloc assembly. The monobloc assembly may be formed from a polyamide or, preferably, a homopolymer acetal resin of polyoxymethylene.

According to another aspect of the invention, the assembly further includes a slot in the body above the lower base, with the deformation zone being between the front of the binding and the slot. The lower base includes a front transverse member and two lateral arms extending from the front transverse member towards the rear of the binding, and a central opening being between the two lateral arms. A lower surface of the upper body defines the upper surface of the slot and a centering plug extends downwardly from the lower surface and is adapted to engage the central opening.

The centering plug has a transverse width which is slightly less than the width of the central opening and includes a friction element which fills the spaces between transverse edges of the centering plug and its respective inner edges of the two lateral arms. The friction element is substantially U-shaped and open towards the rear of the binding to also fill the space between a front edge of the centering plug and a rear edge of the front traverse member.

According to another aspect of the invention the binding includes a front fall sensor for supporting a front part of the sole of the ski boot. The front fall sensor includes a front part and a rear part, and is pivotally mounted at the rear part to the ski. A rocking device is pivotally mounted in the central opening and includes a front portion and a rear portion. The front portion of the front fall sensor contacts the rear portion of the rocking device and the front portion of the rocking device cooperates with the energization mechanism to lessen the amount of force required to release the boot during a front fall.

The rocking device includes a lower member and two lateral wings respectively extending upwardly from the lower member, and an axle extending through the lateral wings for pivotally mounting the rocking device in the central opening.

The energization mechanism includes a spring acting against a force transmission element which is longitudinally movable in the body to cooperate with the jaw to elastically bias the jaw against the front of the boot. At least one lateral wing includes a boss projecting towards the rear of the binding to contact the force transmission element to further compress the spring during a front fall.

According to another aspect of the invention, the binding also includes a compensation mechanism for a rear fall. The compensation mechanism includes a second axle extending through the lateral wings, a substantially vertical hole in the body and a linkage rod being journalled on the second axle and extending through the vertical hole. The upper end of the linkage rod includes a portion which is larger than the size of the vertical hole to pivot the rocking device to cooperate with the energization mechanism to lessen the amount of force required to release the boot during a rear fall. The upper end of the linkage rod has the shape of a downwardly curved hook and a space is formed in the body at the upper end of the vertical hole to receive the upper end of the linkage rod. The rocking device includes a front portion which cooperates with the energization mechanism to lessen the amount of force required to release the boot during a rear fall.

According to another embodiment of the invention, the binding comprises a lip extending from the body and is adapted to come into contact with a portion of the rocking device to pivot the rocking device during a rear fall. A lower surface of the body defines the upper surface of the slot. A centering plug extends downwardly from the lower surface and is adapted to engage the central opening with the lip extending rearwardly from the centering plug.

According to still another embodiment of the invention, the binding includes an abutment to be affixed to the ski rearwardly of the centering plug. The centering plug includes a lip extending under the abutment to allow vertical play between the lip and the abutment.

The binding may also include an abutment to be affixed to the ski rearwardly of the deformation zone with a lip extending from the body to cooperate with the abutment to allow vertical play between the lip and the abutment.

BRIEF DESCRIPTION OF THE DRAWINGS

The invention is further explained in the description which follows with reference to the drawings which illustrate, by way of non-limiting examples, various embodiments of the invention wherein.

DETAILED DESCRIPTION OF THE PREFERRED EMBODIMENTS

The safety ski binding is preferably adapted to releasably hold the front of a boot which is mounted on the ski and comprises a body which supports, in its rear portion, a retention jaw for the boot which includes a central sole-gripping element and two opposed lateral retention wings. An energization mechanism is lodged in the body to elastically return the jaw to the locking position. This energization mechanism includes an energy spring which rests at one end on a force transmission element which is longitudinally movable in the body and is coupled to the jaw so as to elastically bias this jaw against the front of the boot to ensure the retention thereof on the ski. The body of the binding forms an assembly molded of a single piece with a lower part constituting a base for mounting on the ski and an upper body. The lower base and upper body are connected to one another only in the front of the binding by an elastic deformation zone, which constitutes a flexion zone allowing slight vertical movement of the upper body with respect to the base to permit the rear jaw of the body to be automatically adapted in height to soles of boots with different thicknesses.

Figure 1:
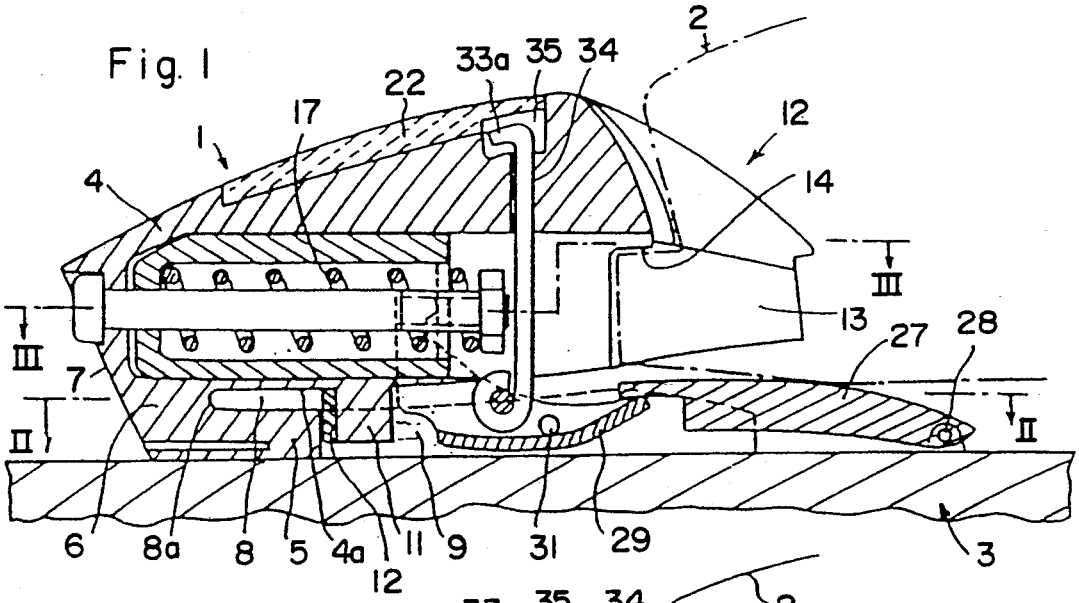
FIG. 1 is a vertical and longitudinal sectional view of a front abutment according to the invention in a rest or locking position.
Figure 2:
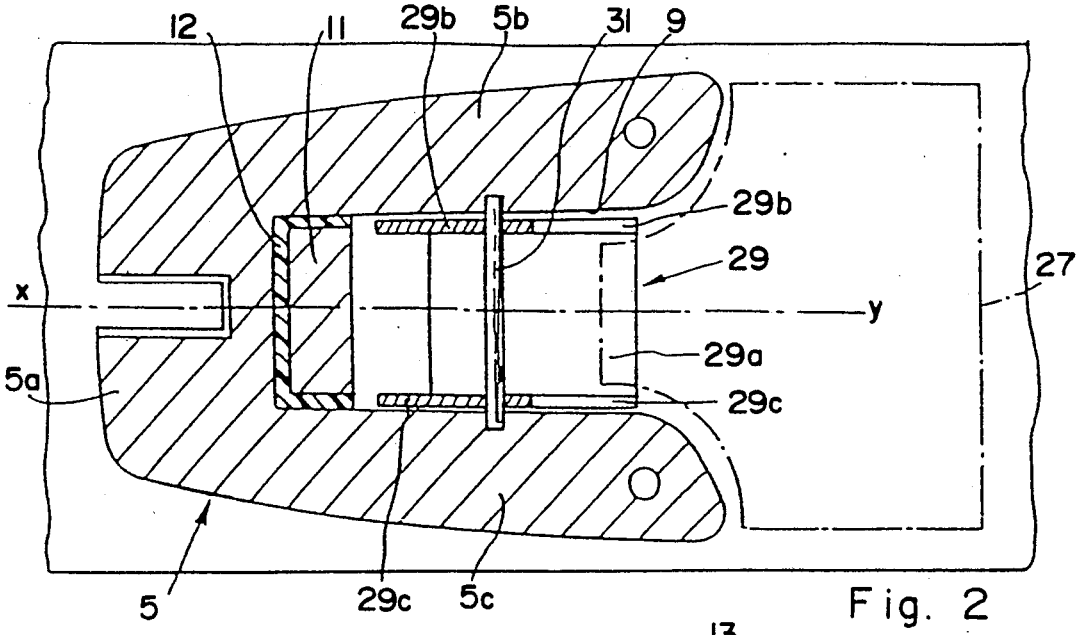
FIG. 2 is a horizontal sectional view along line II—II of FIG. 1.
Figure 3:
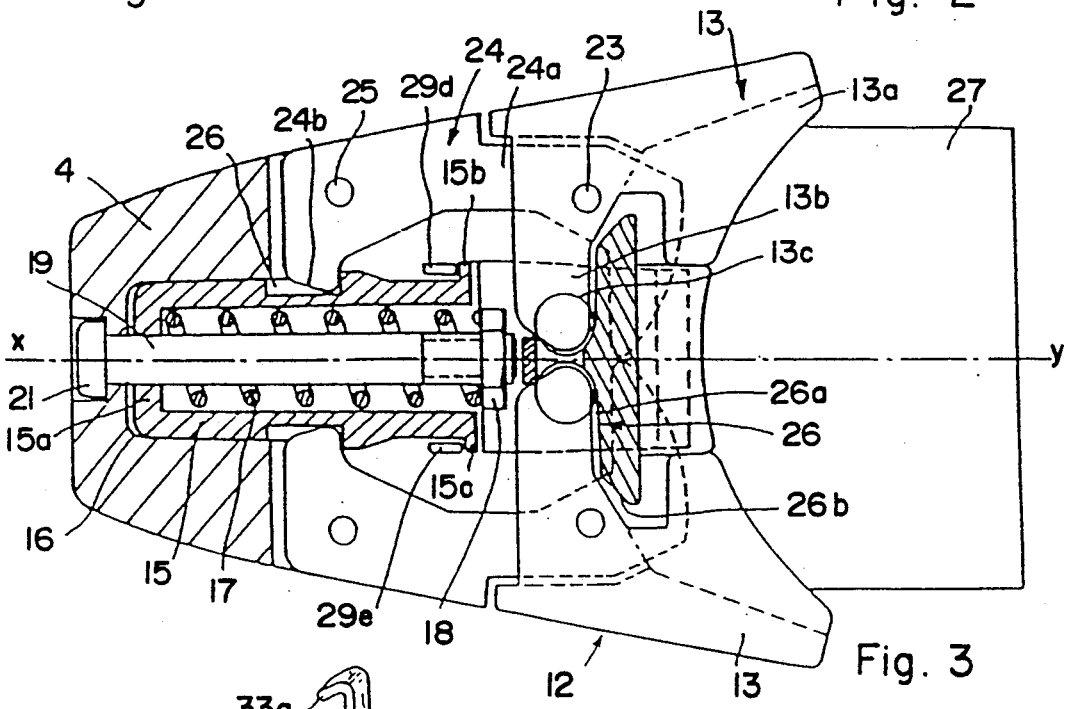
FIG. 3 is a horizontal sectional view along line III—III of FIG. 1.
Figure 6:
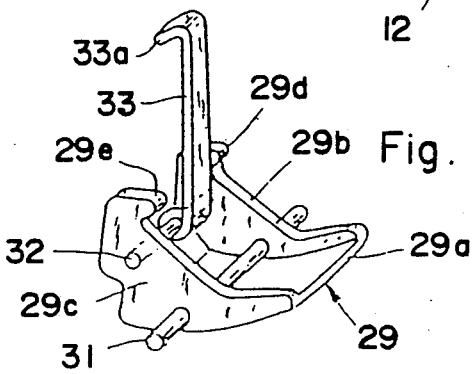
FIG. 6 is a perspective view of the rocking device and the linkage rod which is part of the compensation device for a front fall.

Referring to FIGS. 1-3, a safety binding or "front abutment" 1 is adapted to hold the front of a ski boot 2, shown in chain-dotted lines, on a ski 3. Front abutment 1 includes body 4 which, according to the invention, forms a single piece assembly with a lower part constituting base 5 which is affixed to the ski by any appropriate means. Body 4 and base 5 form a monobloc assembly and are preferably molded by injection. The material used for that purpose is selected to have an appropriate elasticity and resistance. Material known as "DELRIN 100" or "DELRIN 107" which is a homopolymer acetal resin of polyoxymethylene can be used. However, any other appropriate material, particularly a polyamide, can be used. Body 4 and lower base 5 are connected to one another only at the front of the binding by means of an elastic deformation zone 6 which has a short longitudinal extension and constitutes a flexion zone. This deformation or flexion zone 6 is defined between the front surface 7 of the front abutment which is common to body 4 and base 5, and the front transverse end **8*a* of a slot 8, which has a low height and extends horizontally towards the rear between upper body 4 and lower base 5 and which opens into the lateral surfaces and the rear surface of the monobloc assembly constituted by body 4 and base 5**. This assembly thus constitutes an elastic clip in the shape of a C which is open towards the rear.

As seen in FIG. 2, lower base 5 has, in plan view, the general shape of a U, which is open towards the rear and includes a front transverse member **5*a* which includes two lateral arms 5*b*, 5*c* extending towards the rear in a substantially longitudinal direction. The two lateral arms 5*b*, 5*c* of base 5 define between them a central opening 9, having a substantially rectangular shape which is symmetrical with respect to the vertical and longitudinal plane of symmetry xy of the binding and which opens into the rear surface of base 5**.

The lower horizontal surface **4*a* of body 4, which constitutes the upper limit of slot 8, has a centering plug 11 having a parallelepiped shape for projecting downwardly, and which can be partially or totally engaged in the front part of opening 9 of base 5. Centering plug 11 has a transverse dimension which is slightly less than the width of opening 9. Centering plug 11 is covered by friction element 12 which has, in horizontal section, the shape of a U open towards the rear. In other words, friction element 12 is tightly applied between the transverse end of opening 9 and the front surface of centering plug 11 and between the lateral surfaces of opening 9 and the two lateral surfaces of centering plug 11, to fill the spaces defined between the surfaces of plug 11 and those of opening 9**.

In a conventional manner, body 5 includes in its rear part, a jaw 12 adapted to hold the upper edge of the boot sole 2. Jaw 12 includes two lateral retention wings 13 to ensure the vertical retention of the boot and central sole-gripping element 14, which is constituted by a horizontal lip extending towards the rear and molded with body 5.

The energization mechanism of jaw 12 is lodged in body 4 and includes a force transmission element having a tubular tie rod 15 which extends and can slide in longitudinal bore 16 of body 4. Compression spring 17 is located in tubular tie rod 15 and rests, at its front end, on the bottom 15*a* of tubular tie rod 15. At its rear end, compression spring 17 rests on nut 18 which is bored with a threaded axial hole in its center. This hole is on the extreme threaded part of axial rod 19 which passes through bottom 15*a* of tie rod 15. Front head 21 of axial rod 19 projects to the outside of body 4 and is lodged in a space provided in the front surface of body 4. This makes it possible to adjust the axial position of washer 18 by rotation of the axial rod 19, to thus adjust the tension of spring 17 and to thereby adjust the "stiffness" of the binding. Nut 18 can include a longitudinal lug which extends from its upper part whose axial position as viewed through transparent upper cover 22 indicates the adjustment of the "stiffness" of the binding.

Each of wings 13 of jaw 12 is journalled about a vertical axis 23 on the rear part of a respective arm 24. Each arm 24 is journalled on body 4 at its front part about an axis 25. Each arm 24 comprises a large arm 24*a* which is substantially longitudinal and extends towards the rear and is pivoted at its rear to vertical axis 23, so that wing 13 can thus pivot with respect to arm 24. Arm 24 also comprises, at its front part, a small arm 24*b*, which is substantially transverse and extends in the direction of the longitudinal plane of symmetry xy of the binding. This short arm 24*b*. is engaged in space 26 provided in the corresponding lateral surface of tie rod 15.

As can be best seen in FIG. 3, each wing 13 includes an external arm 13*a* which is inclined from front to rear and from the interior to the exterior and which ensures the lateral retention of the boot sole. Wing 13 also comprises in front of its journal axis 23, a transverse arm 13*b* which extends in the direction towards the longitudinal plane of symmetry xy and which supports a roller 13*c* at its end. Roller 13*c* rests on ramp 26 which is solidly affixed to the body of the base. Arm 13*b* is positioned in front of ramp 26. Ramp 26 includes section member 26*a* which extends substantially transversely, i.e., perpendicular to the longitudinal plane of symmetry xy, and which is extended towards the exterior by a part 26*b* which is inclined towards the rear.

The front abutment also comprises a compensation mechanism for a front fall which includes a front fall sensor 27 on which the front part of the boot sole rests and which is journalled at its rear part on ski 3 about a horizontal and transverse axis 28. Front fall sensor 27 rests at its extreme front part, on the rear part of rocking device 29, which is located in central opening 9 of base 5. Rocking device 29 is constituted by a cap comprising a lower member 29*a* and two lateral and vertical wings 29*b*, 29*c* which extend upwardly from member 29*a*. Rocking device 29 pivots with a horizontal and transverse axle 31 which passes through lateral and vertical wings 29*b*, 29*c* in the lower parts thereof, and whose ends engage in transversely aligned holes in the two lateral surfaces of opening 9 of base 5. The two lateral and vertical wings 29*b*, 29*c* have, on the rear edges of their extreme upper parts, respective bosses 29*d*,29*e* which project towards the rear. Bosses 29*d*, 29*e* are in contact, respectively, with lateral projections 15*b*, 15*c*, which extend towards the exterior and are provided on the rear end of tubular tie rod 15.

Moreover, the front abutment includes a compensation mechanism for a rear fall including a horizontal and transverse axle 32 which extends between the two wings 29*b*, 29*c* of rocking device 29, and is slightly above and in front of the journal axle 31 of rocking device 29. Vertical linkage rod 33 is journalled at the central part of axle 31 and extends upwardly. The upper part of linkage rod 33 extends through vertical hole 34 which is provided in the rear part of body 4 above bore 16. The upper end 33*a* of linkage rod 33 includes a head with a width greater than the diameter of hole 34 and is positioned in space 35 formed in the upper surface of body 4. Upper end 33*a* of linkage rod 33 can have, for example, the shape of a hook which is curved downwardly so that the linkage rod 33 has the general shape of a cane. In the rest position, as is shown in FIG. 1, the upper end 33*a* of linkage rod 33 is then free in space 35 to move with a predetermined upward and downward play.

Figure 4:
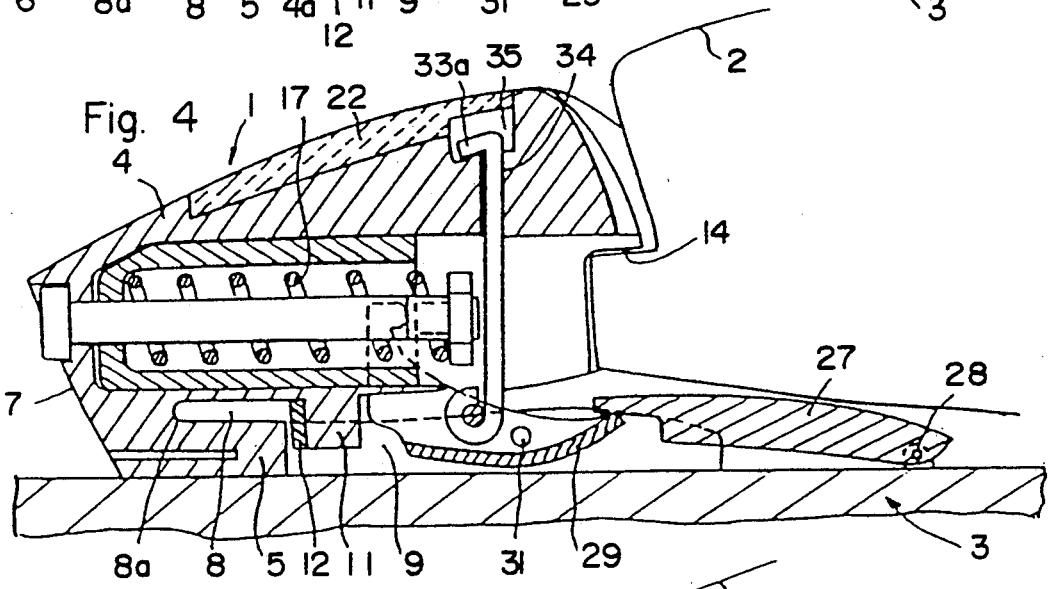
FIG. 4 is a vertical and longitudinal sectional view of the front abutment of FIG. 1 shown holding the front end of a boot whose sole has a thickness which is greater than the initial opening of the jaw.

According to the preceding description, front abutment 1 permits automatic adaptation of the height of jaw 12 to the thickness of boot sole 2, which is held by the abutment. In FIG. 1, as shown in broken lines, boot 2 has a relatively reduced sole thickness, whereas FIG. 4 illustrates the holding of a boot having a greater sole thickness. In FIG. 1, the initial opening of jaw 12, i.e., the height of the space available under the sole-gripping element 14 for the engagement of the boot sole, is minimal. The monobloc assembly, which is constituted by upper body 4 and lower base 5 is at rest, i.e., there is no stress in the flexion zone 6, which constitutes the journalling between body 4 and base 5. Moreover, the upper end 33*a* of linkage rod 33 is located slightly above the bottom of space 35. If the front of a boot 2, whose sole has a greater thickness, is engaged in front abutment 1, as is shown in FIG. 4, the front of this sole forces the sole-gripping element 14 to a raised position along with body 4 with which it is an integral part by being molded together therewith. Body 4 "rocks" somewhat upwardly with respect to lower base 5 about the flexion zone 6 which constitutes the journalling between them, without being retained in this rocking movement by upper end 33*a* of linkage rod 33, because of the play between the hook and the bottom of space 35.

The elastic deformation of body 4 caused by the engagement of a thick sole in jaw 12, causes by reaction a gripping of the boot sole between the lower support plate, which is constituted by front fall sensor 27, and the sole-gripping element 14 of jaw 12. This gripping generates friction which opposes lateral movement of the boot, and in particular its release. The extent of this friction depends on the rigidity of flexion zone 6. However, for the monobloc assembly which is constituted by body 4 and base 5, a sufficiently flexible material is selected so as not to generate an excessive increase in friction between the sole and binding.

According to the preceding description, in the locking position, the two wings 13 for lateral and vertical retention are maintained in the closed position as shown in FIG. 3 by the action of tie rod 15 which is pushed towards the front by compression spring 17. Tie rod 15 presses against the small transverse arms 24*b* so that the large longitudinal arms 24*a* are biased in the direction towards the longitudinal plane of symmetry xy. Consequently, the two wings 13 which are supported by arms 24, are pressed against the edge of the sole of ski boot 2.

In this closed position, the two wings 13 are coupled to form a unitary block with their respective arms 24 by the latching device which is constituted by ramp 26 with transverse section member 26*a* with which each arm 13*b* is in contact through its roller 13*c*.

When the leg of the skier is subjected to torsion, a force by the boot biases one of wings 13 towards the exterior. Since in the closed position, the biased wing 13 is coupled to and forms a unitary block with arm 24 which supports it, the assembly constituted by wing 13 and arm 24 pivots towards the exterior on body 4 about axis 25 against the force of compression spring 17 which pushes tie rod 15. Consequently, the small arms 24*b* of arms 24 pivot towards the front. Wing 13 and arm 24 continue to pivot together towards the exterior until the angular clearance is sufficient so that roller 13*c* which is supported by transverse arm 13*b* of wing 13 arrives at inclined part 26*b*. At this moment, wing 13 is freed because roller 13*c* in effect does not encounter any more resistance to its pivoting movement towards the rear and wing 13 can then pivot freely on its arm 24 about axis 23. The release of the boot takes place at this time.

Figure 5:
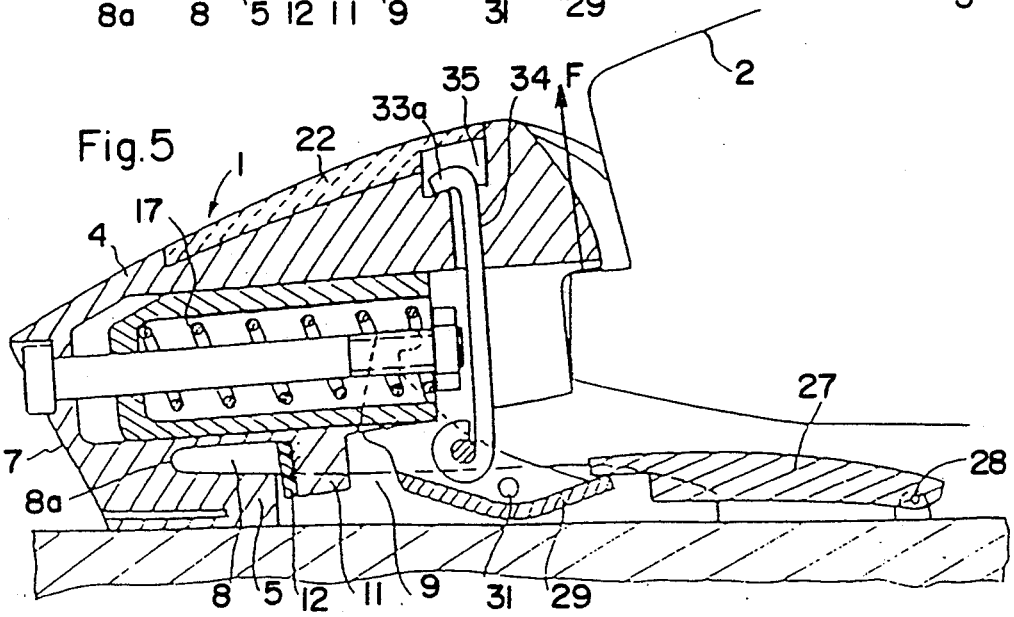
FIG. 5 is a vertical and longitudinal sectional view of the front abutment whose body is biased upwardly by a rear fall.

In the case of a straight rearward fall, the front of the sole of boot 2 forces the sole-gripping element 14 of jaw 12 upwardly, as is indicated by arrow F in FIG. 5, and body 4 consequently rocks upwardly. In the course of the first upward rocking phase of body 4, this displacement occurs freely against only the elastic return force exerted by the deformed body 4. The vertical movement of body 4 in the course of this first phase corresponds to the amount of height adjustment remaining, i.e., that which has not been taken during the engagement of the boot sole in front abutment 1. When body 4 has moved to the remaining height adjustment, body 4 "hooks", by the bottom of space 35, upper end 33*a* of linkage rod 33 and it moves the linkage rod upwardly during a second rocking phase. Linkage rod 33 thus pulls the rocking device 29 upwardly by means of axle 32. Rocking device 29 then pivots about its axle 31 in a clockwise direction, so that the two bosses 29*d*, 29*e*, which are provided on the upper part of the lateral and vertical wings 29*b*, 29*c* of rocking device 29 are displaced towards the rear. During this movement, the bosses push tie rod 15 towards the rear against the return action of spring 17 since they rest against the rear lateral projections 15*b*, 15*c* thereof. The slight displacement of tie rod 15 towards the rear has the effect of somewhat freeing the small front transverse arms 24*b* of arms 24, which slightly frees arms 24 and consequently the lateral retention wings 13. Thus the intensity of the lateral bias which must be reached to cause the release of the front abutment in the case of a rear fall combined with a twisting of the leg is less than that which is required in the case of a pure lateral bias. In fact, a part of the effort absorbed by the additional compression of energization spring 17 has already been furnished by the lifting movement of the front part of the boot which results from the rear fall. Consequently, the "stiffness" of the binding is reduced.

This reduction of the "stiffness" of the binding also occurs in the case of a front fall. In this case, the sole heavily pushes front fall sensor 27, causing a movement thereof in the direction of the upper surface of ski 3 and, consequently, a movement of rocking device 9 in a clockwise direction about axle 31. As a result, axle 32 and consequently linkage rod 33 are somewhat raised, this movement being made possible because upper end 33*a* of linkage rod 33 is free to move upwardly in the upper space 35 of body 4.

Figure 7:
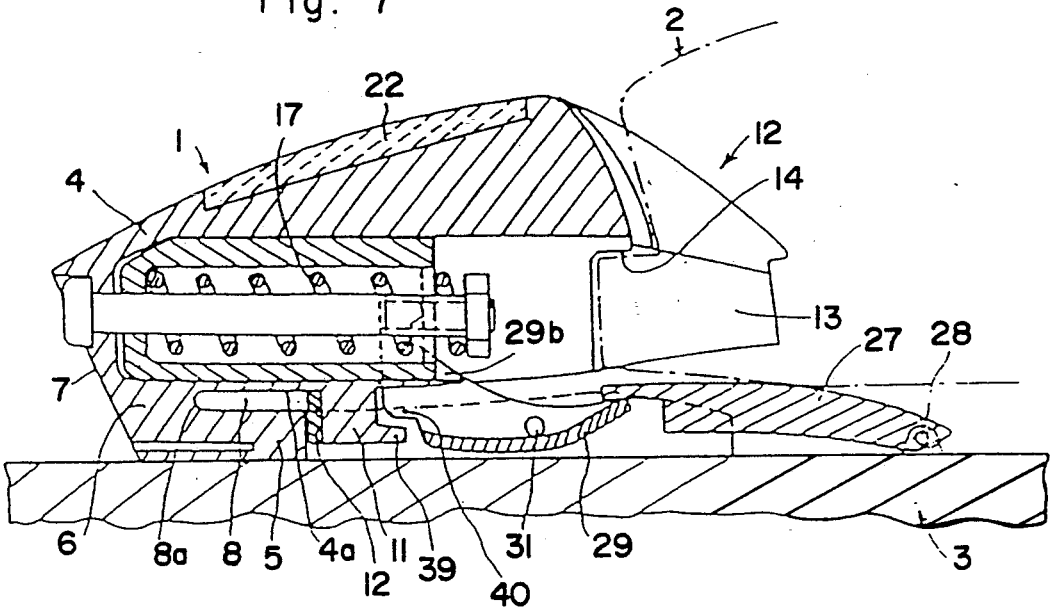
FIG. 7 illustrates an alternative embodiment of a front abutment according to the invention.

According to the alternative embodiment of FIG. 7, the centering plug 11 extends towards the rear by a lip 39 which is located in its lower part. Lip 39 is engaged under rocking device 29, at the position of each of its lateral and vertical wings 29*b*, 29*c*. A support surface 40 is provided on rocking device 29 for lip 39.

Between the upper surface of lip 39 and support surface 40 of rocking device 29, a vertical play exists in the rest position of the binding. This play performs the same role as the play between upper hook 33*a* of linkage rod 33 and the bottom of space 35, shown in FIGS. 1 and 3.

When a boot, with a sole of relatively reduced thickness, is engaged in the binding, the sole-gripping element 14 is not biased upwardly, and the play between lip 39 and support surface 40 remains equal to its initial value.

On the other hand, when a boot with a sole of greater thickness is engaged in the binding, the sole-gripping element 14 is biased and moves upwardly, which causes deformation of friction zone 6, and a decrease in the play between lip 39 and support surface 40.

During skiing, when the boot biases the sole-gripping element 14 upwardly, for example, in the case of a rear fall, lip 39 rests against support surface 40, and biases rocking device 29 in a clockwise direction. This rocking bias also decreases the elastic return force of the wings, and thus the lateral force that the boot must overcome to be released.

Figure 8:
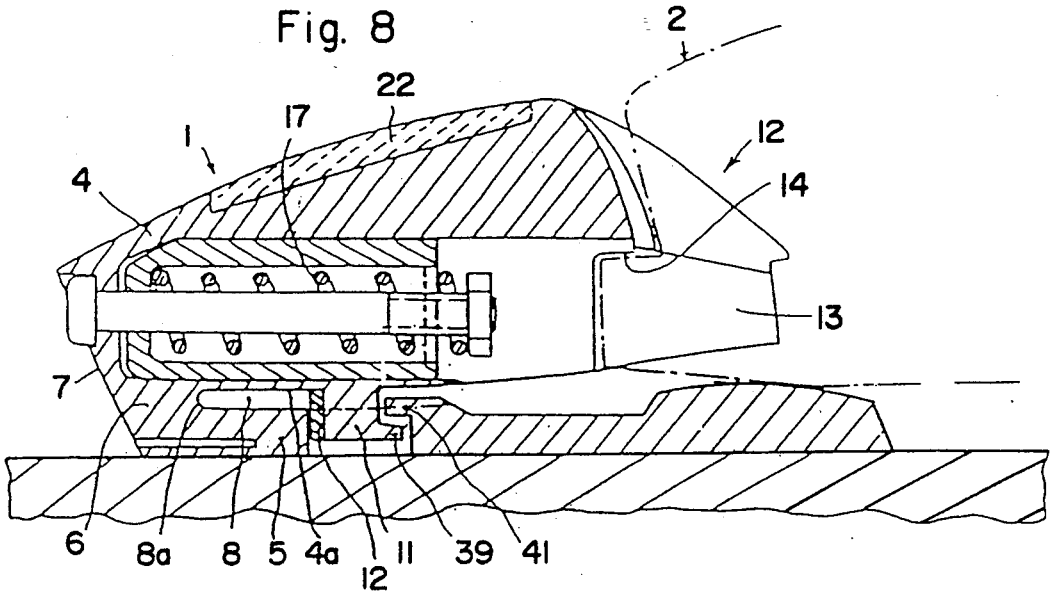
FIG. 8 illustrates another alternative embodiment of the invention.

In the alternative embodiment of FIG. 8, centering plug 11 also has a lip 39. Lip 39 is engaged under an abutment 41 which is solidly affixed to the ski or base 5 of the binding. As in the preceding embodiment, play exists between the upper surface of lip 39 and abutment 41 of the base.

When a boot, with a sole of relatively reduced thickness, is engaged in the binding, the sole-gripping element 14 is not biased upwardly, and the play between lip 39 and abutment 41 does not vary. On the other hand, when a sole of greater thickness is engaged, the sole-gripping element 14 is biased and moves upwardly, which cause elastic deformation of flexion zone 6 and a decrease in play between lip 39 and abutment 41.

When the boot biases the sole-gripping element upwardly, during skiing, lip 39 rests against abutment 41, which retains the sole-gripping element 14 against upward displacement.

Although the invention has been described with reference to particular means, materials and embodiments, it is to be understood that the invention is not limited to the particulars disclosed and extends to all equivalents within the scope of the claims.

We claim:

1. A safety ski binding adapted to be mounted on a ski to releasably hold the front of a sole of a ski boot on the ski, said safety ski binding having a front and rear and further comprising:

a) a unitary assembly comprising a lower base and a body, said assembly being formed in a single piece;

b) a jaw mounted on said assembly for retention of the sole of the ski boot including a sole-gripping element and two opposed lateral retention wings; and c) an energization mechanism movable in said body to elastically bias said jaw toward a locking position;

wherein said lower base is adapted to be mounted on the ski, said lower base and said body are connected together only at the front of the binding at an elastic deformation zone which allows upward movement of said body with respect to said lower base, to permit said jaw to automatically adapt in height to soles with different thicknesses.

2. The safety ski binding according to claim 1, wherein said assembly is molded in a single piece to form a monobloc assembly.

3. The safety ski binding according to claim 2, wherein said monobloc assembly is formed from a polyamide.

4. The safety ski binding according to claim 2, wherein said monobloc assembly is formed from a homopolymer acetal resin of polyoxymethylene.

5. The safety ski binding according to claim 1, further including a slot between said body and said lower base, said deformation zone being between the front of the binding and said slot.

6. The safety ski binding according to claim 5, wherein said lower base includes a front transverse member and two lateral arms extending from said front transverse member towards the rear of said binding, and a central opening being between said two lateral arms.

7. The safety ski binding according to claim 6, wherein a lower surface of said body defines the upper surface of said slot, a centering plug extending downwardly from said lower surface and adapted to engage said central opening.

8. The safety ski binding according to claim 7, wherein said centering plug has a transverse width which is slightly less than the width of said central opening, said centering plug including a friction element to fill the spaces between transverse edges of said centering plug and respective inner edges of said two lateral arms.

9. The safety ski binding according to claim 8, wherein said friction element is substantially U-shaped and open towards the rear of the binding to also fill the space between a front edge of said centering plug and a rear edge of said front traverse member.

10. The safety ski binding according to claim 6, further including a front fall sensor for supporting a front part of the sole of the ski boot, said front fall sensor including a front part and a rear part, said front fall sensor being pivotally mounted at said rear part to the ski, a rocking device pivotally mounted in said central opening, said rocking device including a front portion and a rear portion, said front part of said front fall sensor contacting said rear portion of said rocking device, said front portion of said rocking device cooperating with said energization mechanism to lessen the amount of force required to release the boot during a front fall.

11. The safety ski binding according to claim 10, wherein said rocking device includes a lower member and two lateral wings respectively extending upwardly from said lower member, and an axle extending through said lateral wings for pivotally mounting said rocking device in said central opening.

12. The safety ski binding according to claim 11, wherein said energization mechanism includes a spring acting against a force transmission element, said force transmission element being longitudinally movable in said body to cooperate with said jaw to elastically bias said jaw against the front of the boot.

13. The safety ski binding according to claim 12, wherein at least one of said lateral wings includes a boss projecting towards the rear of the binding to contact said force transmission element to further compress said spring during a front fall.

14. The safety ski binding according to claim 11, further including a compensation mechanism for a rear fall, said compensation mechanism including a second axle extending through said lateral wings, a substantially vertical hole in said body, a linkage rod being journalled on said second axle and extending through said vertical hole, the upper end of said linkage rod including a portion which is larger than the size of said vertical hole, so as to pivot said rocking device to cooperate with said energization mechanism to lessen the amount of force required to release the boot during a rear fall.

15. The safety ski binding according to claim 14, wherein said upper end of said linkage rod has the shape of a downwardly curved hook.

16. The safety ski binding according to claim 14, further including a space formed in said body at the upper end of said vertical hole to receive the upper end of said linkage rod.

17. The safety ski binding according to claim 6, further including a rocking device pivotally mounted in said central opening, said rocking device including a front portion, said front portion cooperating with said energization mechanism to lessen the amount of force required to release the boot during a rear fall.

18. The safety ski binding according to claim 17, wherein said rocking device includes an axle and further including a substantially vertical hole in said body, a linkage rod being journalled on said axle and extending through said vertical hole, the upper end of said linkage rod including a portion which is larger than the size of said vertical hole to pivot said rocking device to cooperate with said energization mechanism to lessen the amount of force required to release the boot during a rear fall.

19. The safety ski binding according to claim 17, further comprising a lip extending from said body and adapted to come into contact with a portion of said rocking device to pivot said rocking device during a rear fall.

20. The safety ski binding according to claim 19, wherein a lower surface of said body defines the upper surface of said slot, a centering plug extending downwardly from said lower surface and adapted to engage said central opening, said lip extending rearwardly from said centering plug.

21. The safety ski binding according to claim 7, including an abutment to be affixed to the ski rearwardly of said centering plug, said centering plug including a lip extending under said abutment to allow vertical play between said lip and said abutment.

22. The safety ski binding according to claim 5, including an abutment to be affixed to the ski rearwardly of said deformation zone, a lip extending from said body to cooperate with said abutment to allow vertical play between said lip and said abutment.

23. A binding for a ski, said binding comprising:

(a) a jaw for engaging an end of a ski boot;

(b) means for automatically compensating for different sole thicknesses of ski boots to be engaged by said jaw, comprising means for biasing said jaw toward the ski;

(c) means for elastically biasing said jaw toward a ski boot engaging position which is independent of said means for biasing said jaw toward the ski;

(d) a body, said jaw being carried by said body, and wherein said means for automatically compensating for different sole thicknesses comprises a flexion area which is unitary with said body for enabling said body to move away from the ski.

24. The binding of claim 23, wherein said jaw comprises laterally movable elements and said means for elastically biasing said jaw toward a ski boot engaging position comprises means for elastically biasing said laterally movable elements toward said ski boot.

25. The binding of claim 23, wherein said jaw is movable laterally.

26. A safety ski binding adapted to be mounted on a ski to releasably hold the front of a sole of a ski boot on the ski, said safety ski binding having a front and rear and further comprising:

(a) a unitary assembly comprising a lower base and a body, said assembly being formed in a single piece;

(b) a jaw mounted on said assembly for retention of the sole of the ski boot including a sole-gripping element and two opposed lateral retention wings;

(c) an energization mechanism movable in said body to elastically bias said jaw toward a locking position; and (d) compensating means for lessening the amount of force required to move said jaw to a release position;

wherein said lower base is adapted to be mounted on the ski, said lower base and said body are connected together at the front of the binding at an elastic deformation zone which allows upward movement of said body with respect to said lower base, and wherein upward movement of said body actuates said compensating means.

27. The safety ski binding according to claim 26, wherein said compensating means is actuated in response to a rear fall.

* * * * *